US006607811B1

(12) United States Patent
Puckett et al.

(10) Patent No.: US 6,607,811 B1
(45) Date of Patent: Aug. 19, 2003

(54) RECEPTIVE LAYER FOR THERMAL TRANSFER PRINTING ON CARTONS

(75) Inventors: Richard D. Puckett, Miamisburg, OH (US); David J. Rainbow, Centerville, OH (US)

(73) Assignee: NCR Corporation, Dayton, OH (US)

( * ) Notice: Subject to any disclaimer, the term of this patent is extended or adjusted under 35 U.S.C. 154(b) by 812 days.

(21) Appl. No.: 09/067,923

(22) Filed: Apr. 29, 1998

Related U.S. Application Data

(62) Division of application No. 08/574,169, filed on Dec. 18, 1995, now Pat. No. 5,776,280.

(51) Int. Cl.[7] ..... B41M 5/00
(52) U.S. Cl. ..... 428/195
(58) Field of Search ..... 428/484, 488.1, 428/488.4, 195, 522

(56) References Cited

U.S. PATENT DOCUMENTS

| | | | | |
|---|---|---|---|---|
| 3,663,278 A | | 5/1972 | Blose et al. | |
| 4,315,643 A | | 2/1982 | Tokunaga et al. | |
| 4,403,224 A | | 9/1983 | Wirnowski | |
| 4,463,034 A | * | 7/1984 | Tokunaga et al. | 428/484 |
| 4,523,207 A | | 6/1985 | Lewis | |
| 4,628,000 A | | 12/1986 | Talvalkar et al. | |
| 4,687,701 A | | 8/1987 | Knirsch et al. | |
| 4,698,268 A | | 10/1987 | Ueyama | |
| 4,707,395 A | | 11/1987 | Ueyama et al. | |
| 4,777,079 A | | 10/1988 | Nagamoto et al. | |
| 4,778,729 A | | 10/1988 | Mizobuci | |
| 4,869,941 A | | 9/1989 | Ohki | |
| 4,923,749 A | | 5/1990 | Talvalkar | |
| 4,975,332 A | | 12/1990 | Shini et al. | |
| 4,983,446 A | | 1/1991 | Taniguchi et al. | |
| 4,988,563 A | | 1/1991 | Wehr | |
| 5,006,502 A | | 4/1991 | Fujimura et al. | |
| 5,089,350 A | | 2/1992 | Talvalkar et al. | |
| 5,128,308 A | | 7/1992 | Talvalkar | |
| 5,240,781 A | | 8/1993 | Obtata et al. | |
| 5,248,652 A | | 9/1993 | Talvalkar | |
| 5,506,189 A | | 4/1996 | Chou et al. | |
| 5,612,120 A | * | 3/1997 | Tago et al. | 428/488.1 |

FOREIGN PATENT DOCUMENTS

| | | |
|---|---|---|
| EP | 0281075 | 9/1988 |
| EP | 0376170 | 7/1990 |
| GB | 2270392 | 3/1994 |

OTHER PUBLICATIONS

Patent Abstracts of Japan, vol. 010, No. 261 (M–514), Sep. 5, 1986 & JP 61 086289 A (Mitsubishi Electric Corp), May 1, 1986.

Patent Abstracts of Japan, vol. 014, No. 052 (M–0928), Jan. 30, 1990 & JP 01 280587 A (Ricoh Co Ltd), Nov. 1, 1989.

* cited by examiner

*Primary Examiner*—Pamela R. Schwartz
(74) *Attorney, Agent, or Firm*—Millen, White, Zelano & Branigan PC

(57) ABSTRACT

There is provided by the present invention, a thermal transfer ribbon for printing directly on cartons without the use of labels and a method for using the same.

3 Claims, 2 Drawing Sheets

RECEPTIVE LAYER FOR THERMAL TRANSFER PRINTING ON CARTONS

This application is a divisional of application Ser. No. 08/574,169, filed Dec. 18, 1995 now U.S. Pat. No. 5,776, 280.

FIELD OF THE INVENTION

The invention relates to thermal transfer printing wherein images are formed on a receiving substrate by heating extremely precise areas of a print ribbon with thin film resistors. Heating of the localized area causes transfer of ink or other sensible material from the ribbon onto the receiving substrate. The sensible material is typically a pigment or dye which can be detected visually, optically or magnetically.

BACKGROUND OF THE INVENTION

In the printing field, the impact type printer has been the predominant apparatus for providing increased throughput of printed information. The impact printers include the dot matrix type wherein individual print wires are driven from a home position to a printing position by individual and separate drivers. The impact printers also include the full character type wherein individual type elements are caused to be driven against a ribbon and record media.

While impact printing has dominated the industry, this type of printing has some disadvantages. One disadvantage of this type of printing is the noise level which is attained during printing operations. Another is that the printing applications are limited to record media which are rigid or can be supported by a platen to resist the impact of the print wires or type elements driven against it during the printing operation.

Thermal printing has been an effective alternative for significantly reducing the noise levels which are attained during printing operations. Since the ink is transferred to the record media by a thermal process, supporting the record media in a rigid fashion is not as critical as in impact printing. Thermal transfer printing has requirements distinct from impact printing which need to be addressed when considering new printing applications. Representative documentation in the area of non-impact printing and thermal transfer printing include the following patents.

U.S. Pat. No. 3,663,278, issued to J. H. Blose et al. on May 16, 1972, which discloses a thermal transfer medium having a coating composition of cellulosic polymer, thermoplastic resin, plasticizer and a "sensible" material such as a dye or oxide pigment material.

U.S. Pat. No. 4,315,643, issued to Y. Tokunaga et al. on Feb. 16, 1982, discloses a thermal transfer element comprising a foundation, a color developing layer and a hot melt ink layer. The ink layer includes heat conductive material and a solid wax as a binder material.

U.S. Pat. No. 4,403,224, issued to R. C. Winowski on Sep. 6, 1983, discloses a surface recording layer comprising a resin binder, a pigment dispersed in the binder, and a smudge inhibitor incorporated into and dispersed throughout the surface recording layer, or applied to the surface recording layer as a separate coating.

U.S. Pat. No. 4,463,034, issued to Y. Tokunaga et al. on Jul. 31, 1984, discloses a heat-sensitive magnetic transfer element having a hot melt or a solvent coating.

U.S. Pat. No. 4,523,207, issued to M. W. Lewis et al. on Jun. 11, 1985, discloses a multiple copy thermal record sheet which uses crystal violet lactone and a phenolic resin.

U.S. Pat. No. 4,628,000, issued to S. G. Talvalkar et al. on Dec. 9, 1986, discloses a thermal transfer formulation that includes an adhesive-plasticizer or sucrose benzoate transfer agent and a coloring material or pigment.

U.S. Pat. No. 4,687,701, issued to F. Knirsch et al. on Aug. 18, 1987, discloses a heat sensitive inked element using a blend of thermoplastic resins and waxes.

U.S. Pat. No. 4,698,268, issued to S. Ueyama on Oct. 6, 1987, discloses a heat resistant substrate and a heat-sensitive transferring ink layer. An overcoat layer may be formed on the ink layer.

U.S. Pat. No. 4,707,395, issued to S. Ueyama et al. on Nov. 17, 1987, discloses a substrate, a heat-sensitive releasing layer, a coloring agent, and a heat-sensitive cohesive layer.

U.S. Pat. No. 4,777,079, issued to M. Nagamoto et al. on Oct. 11, 1988, discloses an image transfer type thermosensitive recording medium using themosoftening resins and a coloring agent.

U.S. Pat. No. 4,778,729, issued to A. Mizobuchi on Oct. 18, 1988, discloses a heat transfer sheet comprising a hot melt ink layer on one surface of a film and a filling layer laminated on the ink layer.

U.S. Pat. No. 4,869,941, issued to Ohki on Sep. 26, 1989, discloses an imaged substrate with a protective layer laminated to the imaged surface.

U.S. Pat. No. 4,923,749, issued to Talvalkar on May 8, 1990, discloses a thermal transfer ribbon comprising two layers which remain non-integral. One layer comprises a thermal sensitive coating, the other comprises a protective layer.

U.S. Pat. No. 4,975,332, issued to Shini et al. on Dec. 4, 1990, discloses a thermal transfer ribbon with an adhesive improving layer, an electrically resistant layer and a heat sensitive transfer ink layer.

U.S. Pat. No. 4,983,446, issued to Taniguchi et al. on Jan. 8, 1991, discloses a thermal transfer ribbon comprising a saturated linear polyester resin, a wax and a carbon black pigment.

U.S. Pat. No. 4,988,563, issued to Wehr on Jan. 29, 1991, discloses a thermal transfer ribbon comprising a thermal sensitive coating and a protective coating. The protective coating comprises ethylene vinyl acetate copolymer and wax which provides reduced ribbon offset.

U.S. Pat. No. 5,089,350, issued to Talvalkar et al. on Feb. 18, 1992, discloses a thermal transfer ribbon having a layer comprising a mixture of waxes, a hydrocarbon polymer, an acetate copolymer and fluorescent pigment having a specific color.

U.S. Pat. Nos. 5,128,308 and 5,248,652, issued to Talvalkar each disclose a thermal transfer ribbon containing water-based thermally reactive ingredients for creating colored images. These thermally active ingredients comprise a leuco dye and a phenolic resin which create color upon the application of heat.

And, U.S. Pat. No. 5,240,781, issued to Obatta et al., discloses an ink ribbon for thermal transfer on rough surfaces To provide printed information on cartons by thermal transfer printing, the information is printed on a label or other medium which is then applied to the carton. The materials and equipment used in preparing and applying the labels comprises a significant portion of the total cost of the printing operation. Printing directly onto the carton would provide significant savings over the use of labels, however, because of limitations on the equipment used and the print obtained, this has not been feasible. The surfaces of cartons are rough and non-receptive to the ink transferred, causing problems in clarity, adhesion, etc. In addition, most conventional thermal transfer printers employ a print head which requires the receiving substrate be fed through a curved or sinusoidal path so that proper handling of the packages would be difficult. Recent advances in print head designs provide an opportunity to overcome this handling limitation; however, problems with the print clarity and adhesion on the rough surfaces still remain.

SUMMARY OF THE INVENTION

It is an object of the present invention to eliminate the need for labels in providing thermal printed material on cartons.

It is another object of the present invention to provide a method for printing directly on a carton by thermal transfer printing.

It is yet another object of the present invention to provide a thermal transfer ribbon which allows for the direct application of data onto a carton or package.

Still, another object of the present invention is to provide a thermal transfer ribbon which forms a receptive layer for thermal transfer print.

A further object of the present invention is to provide a thermal transfer ribbon which includes a coating of thermal transfer material that provides a receptive layer for thermal transfer ink and also a coating of thermal transfer ink. Such a ribbon enables the receptive layer and thermal transfer ink to be deposited on a substrate simultaneously.

An additional object of the present invention is to provide a receptive layer for thermal transfer ink which provides a white background for contrast.

These and other objects will be apparent and fully understood from the following description taken together with the annexed drawings and claims.

In a process aspect of the present invention, there is provided a method of printing images directly on a carton. This method comprises printing a receptive layer on the carton by a thermal transfer printer and printing an image on the receptive layer also by a thermal transfer printer. The receptive layer enhances the adhesion of the image to the carton and preferably enhances contrast of the image for scanning purposes.

In a product aspect of the invention, there is provided a thermal transfer ribbon having a flexible substrate and a coating of a thermal transfer material which provides a receptive layer for thermal transfer ink. In certain embodiments, the thermal transfer ribbon additionally contains a coating of thermal transfer ink between the substrate and the coating of thermal transfer material which provides the receptive layer. These embodiments enable simultaneous transfer of the receiving layer and ink layer to a substrate.

DETAILED DESCRIPTION OF THE DRAWINGS

DESCRIPTION OF THE PREFERRED EMBODIMENTS

Figure 1:
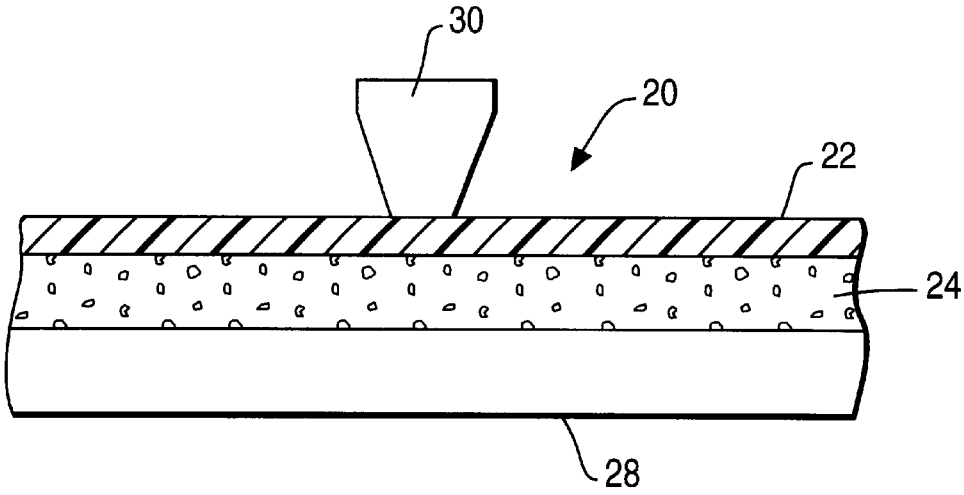
FIG. 1 illustrates a thermal transfer ribbon of the present invention in a printing operation prior to thermal transfer.
Figure 2:
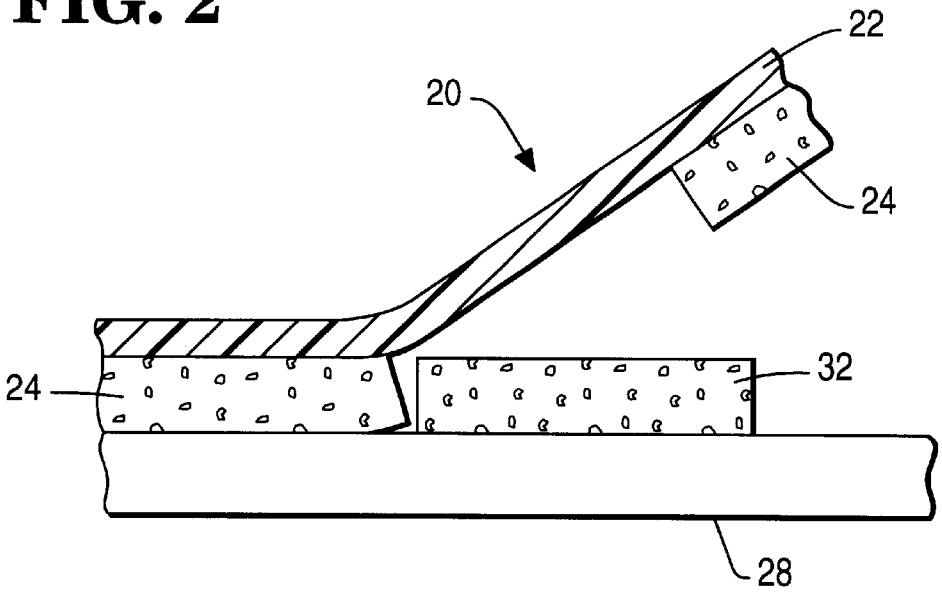
FIG. 2 shows a thermal transfer ribbon of the present invention in a printing operation following thermal transfer of the material which provides a receptive layer for thermal transfer ink on a receiving substrate.

The thermal transfer ribbons of the present invention have a coating of a thermal transfer material which provides a receptive layer for thermal transfer print on rough surfaces such as that of a carton. FIGS. 1 and 2 illustrate a thermal transfer ribbon 20 of this invention which comprises a substrate 22. Substrate 22 is a flexible material and preferably comprises a smooth tissue-type paper such as 30–40 gauge capacitor tissue manufactured by Glatz, or polyester-type plastic material such as 14–35 gauge polyester film manufactured by Dupont under the trademark Mylar®. The substrates preferably have high tensile strength to provide ease in handling and coating and preferably provide these properties at minimum thickness and low heat resistance to prolong the life of the print elements within the thermal print heads. A coating 24, which is thermally sensitive, is positioned on substrate 22. Coating 24 comprises a thermal transfer material which provides a receptive layer for thermal transfer ink. Coating 24 is transferred to a receiving substrate, i.e., a carton, when heated by a thermal print head 30. Thermal transfer provides receptive layer 32 on carton 28 for thermal transfer ink. The receptive layer allows for thermal printing of images on rough surfaces of a carton without voids.

The thermal transfer material which provides the receptive layer is formulated to provide a flexible coating at high coat weights. Flexibility is required to avoid flaking off of the substrate. The high coat weights allow the material to fill voids on the carton surfaces and provide high hiding power and a smooth surface for the ink layer. Preferred formulations which provide these features are mixtures of Paraffin (40–50 weight percent) and elastomeric resin (10–15 weight percent) and pigment such as $TiO_2$ (40–50 weight percent). It is also important that these formulations have a melt viscosity which provides flow, even when used at high coat weights, and with high loadings of pigments of above 30 wt. %, based on total solids.

The thermal transfer material that provides this receptive layer comprises wax as a main component. Suitable waxes provide temperature sensitivity and flexibility. Examples include natural waxes such as carnauba wax, rice wax, bees wax, lanolin, candelilla wax, motan wax and ceresine wax; petroleum waxes such a paraffin wax and microcrystalline waxes; synthetic waxes such as oxidized wax, ester wax, low molecular weight polyethylene and Fisher-Tropsch wax; higher fatty acids such as lauric acid, myristic acid, palmitic acid, stearic acid and behenic acid; higher aliphatic alcohols such as stearyl alcohol; esters such as sucrose fatty acid esters, sorbitan fatty acid esters and amides. The wax-like substances preferably have a melting point of from 100° F. to 250° F., more preferably 140° F. to 220° F. and most preferably 155° F. to 200° F. The amount of wax in the thermal transfer material preferably ranges from 25 to 55 weight percent, most preferably 40 to 50 weight percent, based on the weight of dry ingredients.

The thermal transfer material that provides the receptive layer also comprises elastomeric resin. An elastomeric resin as defined herein has a carbon backbone and a % elongation of at least 500%, preferably 500%–900%. Preferred elastomers have a tensile strength of 2,500–6,000 psi and hardness (Shore A) 70±10. Resins with such properties can include an acrylic acid-ethylene-vinyl acetate terpolymer, methacrylic acid-ethylene-vinyl acetate terpolymer, acrylic acid-ethylene-ethylacetate terpolymer, and other (meth) acrylic acid alkyene alkyl acetate terpolymers, polyvinylchloride, polyvinyl acetate, vinylchloride-vinyl acetate copolymer, polyethylene, polypropylene, ethylene-vinyl acetate copolymer, ethylene-ethyl acetate copolymer, styrene copolymer, nitrile rubber, acrylic rubber, ethylene-propylene rubber, polyurethane resin, ethylene-alkyl (meth) acrylate copolymer, polyvinyl alcohol, and styrene-alkyl (meth)acrylate copolymer. These resins preferably have a softening temperature of from 80° F. to 250° F. The amount of elastomeric resin preferably ranges from 5 to 40 weight %, particularly 10 to 20 weight %, based on the weight of total dry ingredients of the thermal transfer material.

The thermal transfer material may additionally contain thermoplastic resins which do not satisfy the definition of "elastomer" herein if compatible with the elastomer and the blend therewith has at least 500% elongation. Suitable thermoplastic resins are those defined above as elastomers which do not meet the minimum % elongation.

In preferred embodiments, the thermal transfer material which provides the receptive layer contains a pigment to provide contrast or background color for the ink layer. The pigments employed are preferably light colored pigments. Most preferably, the receptive layer is colored white. The pigments are employed at levels varying from 5 to 80 weight percent, preferably 40 to 50 weight percent of the total dry ingredients in the thermal transfer material. Typically, high loadings of pigment are desired of about 50 weight percent so as to enhance the hiding power of the receptive layer obtained. The thermal transfer material which provides the receptive layer may contain other optional additives to enhance such properties as flexibility, softening, viscosity and smoothness. These optional additives include plasticizers such as adipic acid esters, phthalic acid esters, chlorinated biphenyls, citrates, epoxides, glycerols, glycols, hydrocarbons, chlorinated hydrocarbons, phosphates, and the like. Other optional additives include flexibilizers such as oil, weatherability improvers such as U.V. light absorbers and fillers.

The thickness of the receiving layer must be sufficient to fill any voids and provide a smooth top surface for the ink layer. Coating weights for the thermal transfer material on substrate 22 preferably range from 7.75 to 23.25 g/m$^2$ more preferably 13.5 to 17.5 g/m$^2$.

The thermal transfer material which provides the receptive layer can be applied to a substrate from a coating formulation which is a solution/dispersion/emulsion of ingredients described above. The solids content of the coating formulation is typically 25 to 60 weight percent, preferably 25 to 45 weight percent. Conventional coating techniques can be used such as Meyer Rod or like wire-round doctor bar set up on a typical solvent coating machine to provide the desired coating thickness, preferably 0.0005 to 0.002 inches. After the coating is applied to the substrate, it is dried at an elevated temperature in the range of 93° C. to 120° C.

The receptive layer can be applied separately from the ink layer by a separate thermal print head such that the thermal transfer ribbon need only contain the thermal transfer material for the receptive layer. However, included in this invention are embodiments of thermal transfer ribbons which include an additional coating of thermal transfer ink with a sensible material. Both coatings transfer to the receiving substrate simultaneously. The coatings must be sufficiently compatible so as to melt and transfer under identical printing conditions without integration. The two coatings preferably have a total thickness of 11.6 to 23.25 g/m$^2$.

The sensible material includes those well known in the art such as dyes and pigment which are sensed either visually, optically or magnetically. Examples are described in U.S. Pat. No. 3,663,278. When applied separately from the receiving layer, the thermal transfer ink can vary widely in composition with respect to the sensible material employed and the binder. Conventional thermal transfer inks such as those disclosed in U.S. Pat. Nos. 3,663,278 and 4,923,749, are contemplated to be suitable for use with the thermal transfer ribbons of this invention. The binder for the thermal transfer ink will typically be comprised of waxes, polymers and plasticizers in the same ratios as those known in the art. It is also contemplated a multi-layer ink formulations such as those disclosed in U.S. Pat. Nos. 5,128,308 and 5,248,622 can be separately applied to the receptive layer. Where the thermal transfer ink is transferred simultaneously with the receptive layer, the binder and pigments selected should provide softening properties and flow characteristics which match those of the thermal transfer material for the receptive layer. It is preferable that the binder composition and pigment loading used in the thermal transfer ink be substantially identical to that of the binder used in the thermal transfer material for the receptive layer.

Figure 3:
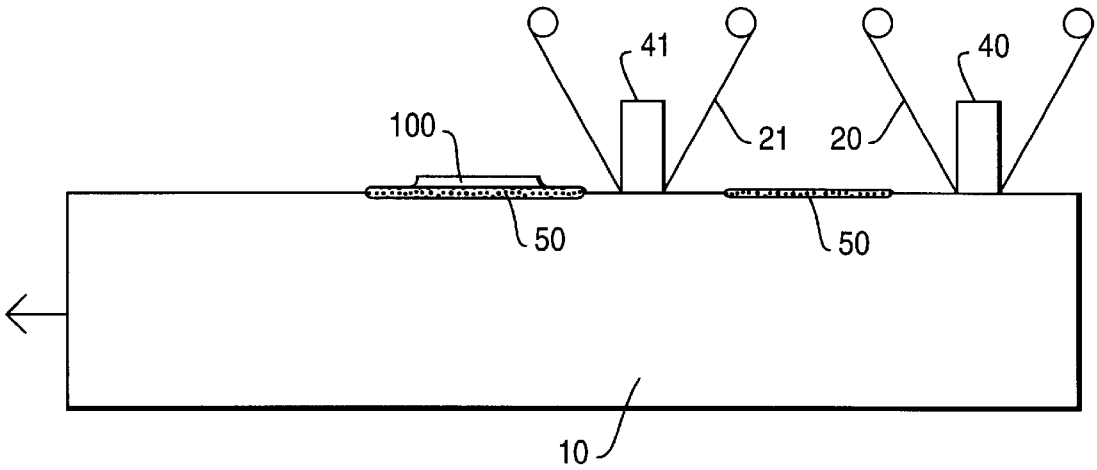
FIG. 3 is a schematic representation of an apparatus which performs a method of this invention in thermally printing directly on a carton.

The thermal transfer ribbons of the present invention find use in printing methods such as those of this invention. The methods of this invention provide images by thermal transfer printing directly on a carton. In these methods a receptive layer is first deposited on the carton by a printer from a thermal transfer ribbon having the thermal transfer material described above. Upon transfer of the receptive layer, an image is printed on the receptive layer by thermal transfer of an ink. This ink preferably contains a sensible material for providing a scannable image. Such inks are well known in the art as are methods for their production and deposition. The thermal printers employed in the processes of this invention preferably contain near-edge thermal transfer print heads. Such print heads provide the necessary localized heating near the edge of the print head itself. This enables the thermal transfer printer to operate with a straight web path instead of a curved or sinusoidal path as required of other printers. The straight web path is conducive to print directly on boxes or cartons in a conveyor-type manufacturing setting.

Where the receptive layer is applied by a separate ribbon, a multi-head thermal printer is preferred for depositing the receptive layer and ink. Thermal printers with as many as four print heads are available, enabling up to three colors to be utilized on the receptive layer. FIG. 3 illustrates an apparatus performing a method of this invention wherein a receptive layer 50 is deposited on carton 10, traveling in a straight path in the direction of the arrow. Receptive layer 50 is deposited from a thermal transfer ribbon 20 by print head 40. Ink layer 100 is deposited on receptive layer 50 from a separate ribbon 21 and print head 41. Preferably, print heads 40 and 41 are part of a single multi-head printer.

Figure 4:
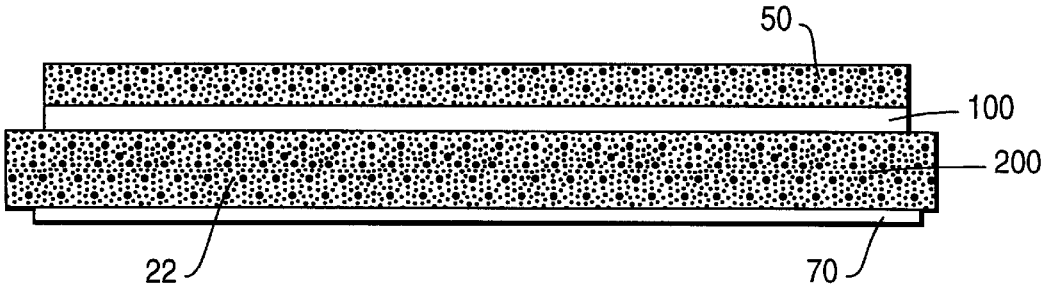
FIG. 4 is a side view of a thermal transfer ribbon according to the present invention having a flexible substrate, a coating of thermal transfer material which provides a receptive layer for thermal transfer ink and a coating of thermal transfer ink.

Thermal printers with only a single print head are well suited for use of thermal transfer ribbons of the present invention having a multi-layer ribbon, wherein the outermost layer provides the receptive layer and the innermost layer provides the ink layer. FIG. 4 illustrates such a ribbon 200 comprising a substrate 22, with a coating 100 of thermal transfer ink deposited thereon and a coating 50 of thermal transfer material which provides the receptive layer. The coating which provides the receptive layer is preferably at least 50% thicker than the coating of thermal transfer ink, as is shown in FIG. 4. Ribbon 200 has an optional backing layer 70.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

The entire disclosure of all applications, patents and publications, cited above and below, are hereby incorporated by reference.

What is claimed is:

1. A thermal transfer ribbon comprising a flexible substrate and a coating on said substrate of a thermal transfer material which provides a receptive layer for thermal transfer ink when transferred to a receiving substrate, wherein said thermal transfer material comprises wax, 5–40 wt. %, elastomeric resin and white pigment and the weight of said coating on said substrate ranges from 7.75 to 23.25 g/m$^2$, wherein the white pigment comprises 40 to 50 weight percent of the total dry ingredients within the thermal transfer material.

2. A thermal transfer ribbon as in claim 1, wherein the coating of thermal transfer material has a coating weight within the range of 13.5 to 17.5 g/m$^2$.

3. A thermal transfer ribbon as in claim 1, wherein the thermoplastic elastomeric resin comprises an elastomer selected from the group consisting of acrylic-acid-ethylene-vinyl acetate terpolymer, ethylene vinyl acetate copolymer, ethylene ethylacetate copolymer, methacrylic acid ethylene vinyl acetate terpolymer and acrylic acid ethylene-ethyl acetate terpolymer.

* * * * *